US005964245A

United States Patent [19]

Liberty

[11] Patent Number: 5,964,245

[45] Date of Patent: Oct. 12, 1999

[54] FLUID HANDLING SYSTEM

[75] Inventor: Jim Lionel Liberty, Lawrenceville, Ga.

[73] Assignee: ROF Group, Spartanburg, S.C.

[21] Appl. No.: 09/126,209

[22] Filed: Jul. 30, 1998

[51] Int. Cl.[6] ..... A62C 35/00

[52] U.S. Cl. ..... 137/355.26; 137/355.16

[58] Field of Search ..... 137/355.26, 355.27, 137/355.16, 355.17

[56] References Cited

U.S. PATENT DOCUMENTS

| | | | |
|---|---|---|---|
| 1,746,995 | 2/1930 | Edwards | 137/355.26 |
| 2,219,201 | 10/1940 | Smith | 137/355.23 |
| 2,340,630 | 2/1944 | Ungar | 137/355.19 |
| 2,576,335 | 11/1951 | Fanslow | 242/97 |
| 2,629,630 | 2/1953 | Roark | 137/355.17 |
| 3,481,557 | 12/1969 | Miller | 242/96 |
| 4,061,290 | 12/1977 | Harrill | 242/96 |
| 4,467,979 | 8/1984 | Koehler | 242/96 |
| 4,676,267 | 6/1987 | Bloch | 137/355.27 |
| 5,052,432 | 10/1991 | Vonalt et al. | 137/355.16 |
| 5,238,105 | 8/1993 | Smiley | 242/77 |
| 5,518,023 | 5/1996 | Garcia | 137/355.26 |
| 5,655,728 | 8/1997 | Yang | 242/402 |
| 5,727,745 | 3/1998 | Vara | 242/395 |

*Primary Examiner*—A. Michael Chambers
*Attorney, Agent, or Firm*—Hardaway/Mann IP Group; Nexsen Pruet Jacobs & Pollard, LLP

[57] ABSTRACT

A hose reel comprising: an outer hub including: opposite ends; a hollow interior extending between the opposite ends; and an opening through the hub and in communication with the hollow interior; a pair of walls, each attached to one of the opposite ends of the outer hub; and an inner hub attached to the outer hub and positioned within the hollow interior of the outer hub. The walls and the outer hub define a first storage area therebetween. The inner hub and outer hub define a second storage area therebetween. The aperture receives the medial portion of the hose so that a first length of the hose resides within the first storage area and a second length of the hose resides within the second storage area.

20 Claims, 3 Drawing Sheets

FLUID HANDLING SYSTEM

BACKGROUND OF THE INVENTION

The present invention relates generally to a fluid handling system. Specifically, the present invention relates to a hose reel. As used herein, the term fluid refers to both a liquid and a gas.

Numerous types of operations require fluid handling systems. For instance, manufacturing and maintenance operations use various types of fluid handling systems. Many of the operations prefer to dispense fluids from a bulk supply of the fluid. Supplying fluid from a bulk supply requires piping from the bulk supply to the manufacturing or maintenance location. Hose reels are commonly used to supply the fluid from a bulk supply to a desired location.

U.S. Pat. Nos. 4,676,267 to Bloch and 5,052,432 to Vonalt et al. disclose a common type of hose reel. The patents describe hose reels that use live swivels. Live swivels connect a supply hose or piping to the hose reel piping. While allowing fluid flow between the supply hose or piping and the hose reel piping, the live swivel also allows the hose reel to pivot relative to the supply line. A discharge hose connects to the other end of the hose reel piping. The hose reel winds and unwinds the discharge hose. In many applications, such as the food service industry, the use of internal hose reel piping and a supply line to the reel is not preferred.

U.S. Pat. No. 5,238,105 to Smiley discloses a hose reel used strictly for the storage and dispensing of hose or tubing and associated fittings. The device does not describe the use of the hose reel to transport fluid. As such, the device does not utilize internal piping. The hose reel includes a hub having an hollow interior formed into several sections. Each section can carry various loose hose fittings. The sections are secured by a removable cover plate to retain the loose fittings therein.

When the operator plays a suitable amount of hose from the hose reel, the operator cuts the hose and applies a fitting to the newly severed hose end. The hose reel merely dispenses the irrigation hose that is carried thereon. The hose reel is not involved when fluid travels through the irrigation hose.

While suitable for their specific applications, the aforementioned hose reels are not useful in many other applications. Clearly, there is room for improvement in the art.

SUMMARY OF THE INVENTION

Therefore, it is an object of the present invention to provide an improved fluid handling system.

It is a further object of the present invention to provide an improved hose reel.

It is a further object of the present invention to provide a hose reel that does not require internal piping or an external supply line.

It is a further object of the present invention to provide a hose reel that operates with only one hose.

It is a further object of the present invention to provide a hose reel that includes two compartments to store portions of a single hose therein.

These and other objects are achieved in one aspect of the present invention by a hose reel comprising: an outer hub including: opposite ends; a hollow interior extending between the opposite ends; and an opening through the hub and in communication with the hollow interior; a pair of walls, each attached to one of the opposite ends of the outer hub; and an inner hub attached to the outer hub and positioned within the hollow interior of the outer hub. The walls and the outer hub define a first storage area therebetween. The inner hub and outer hub define a second storage area therebetween. The opening receives the medial portion of the hose so that a first length of the hose resides within the first storage area and a second length of the hose resides within the second storage area.

These and other objects are achieved in a second aspect of the present invention by a fluid handling system comprising: a hose; and a hose reel comprising: an outer hub including: opposite ends; a hollow interior extending between the opposite ends; and an opening through the hub and in communication with the hollow interior; a pair of walls, each attached to one of the opposite ends of the outer hub; and an inner hub attached to the outer hub and positioned within the hollow interior of the outer hub. The walls and the outer hub define a first storage area therebetween. The inner hub and outer hub define a second storage area therebetween. The opening receives the medial portion of the hose so that a first length of the hose resides within the first storage area and a second length of the hose resides within the second storage area.

These and other objects are achieved in a third aspect of the present invention by a hose reel comprising: an outer hub including: opposite ends; a hollow interior extending between the opposite ends; and an opening through the hub and in communication with the hollow interior; a first wall attached to one end of the outer hub; a second wall attached to the other end of the outer hub, the second wall having: an annular groove; and a notch in said annular groove; an inner hub attached to the first wall and positioned within the hollow interior of the outer hub; a removable plate seatable within the annular groove of the second wall, the plate having: an outer edge corresponding to the annular groove of the second wall; and a projection corresponding to the notch in the second wall for seating the plate within the annular groove, the plate being rotatable so the plate remains within the annular groove of the second wall when the projection is no longer aligned with the notch in the second wall. The first wall, second wall and outer hub define a first storage area therebetween. The inner hub and outer hub define an annular-shaped second storage area therebetween. The aperture can receive the medial portion of the hose so that a first length of the hose resides within the first storage area and a second length of the hose resides within the second storage area.

BRIEF DESCRIPTION OF THE DRAWINGS

The features of the present invention will become apparent to those skilled in the art to which the present invention relates from reading the following specification with reference to the accompanying drawings in which.

DETAILED DESCRIPTION OF THE PREFERRED EMBODIMENTS

Figure 1:
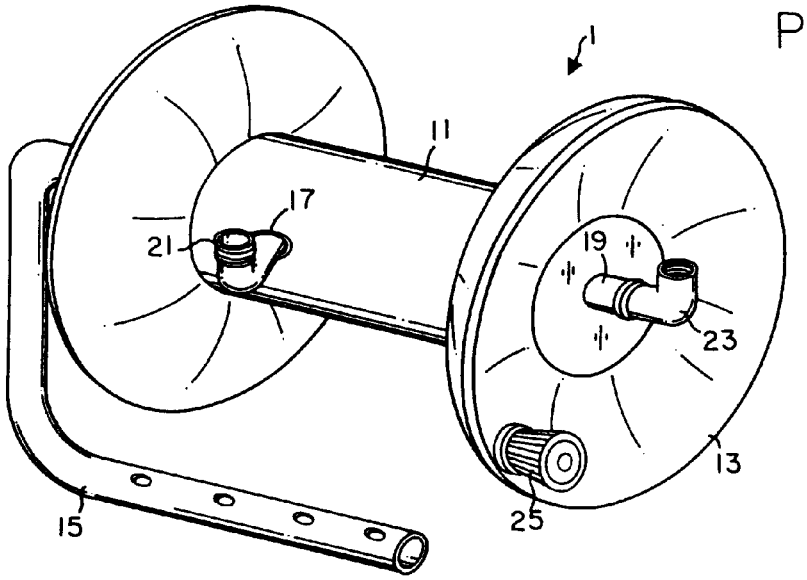
FIG. 1 PRIOR ART
FIG. 1 is a perspective view of a conventional hose reel assembly.

As used herein, the term fluid refers to both liquids and gases. FIG. 1 is a perspective view of a conventional hose reel 1. Hose reel 1 includes a hub 11 with walls 13 flanking the ends of hub 11. A bar 15 allows mounting of hose reel 1 to any desired object, such as a wall (not shown). A bearing assembly (not shown) allows rotation of hub 11 relative to bar 15 using handle 25.

Hub 11 has a hollow interior (not shown) and an aperture 17 in communication with the hollow interior. A pipe 19 extends along the hollow interior and through aperture 17. The end of pipe 19 extending through aperture 17 includes a hose coupling, such as threads 21 to receive a female end of a hose (not shown).

The opposite end of pipe 19 has a live swivel 23 secured thereto. Live swivel 23 can, for example, receive a male end of a second hose or piping (not shown). Live swivel 23 allows rotation of hub 11 relative to the non-rotating hose or piping (not shown) secured to live swivel 23. This permits flow through the hose, supply line and pipe 19. Hose reel 1 requires many connections for proper operation.

In many applications, such as the food service industry, the use of hose reel 1 which utilizes pipe 19 raises concerns. For instance, the presence of a liquid in pipe 19 after use of hose reel 1 may contaminate a subsequent use of hose reel 1.

Figure 2:
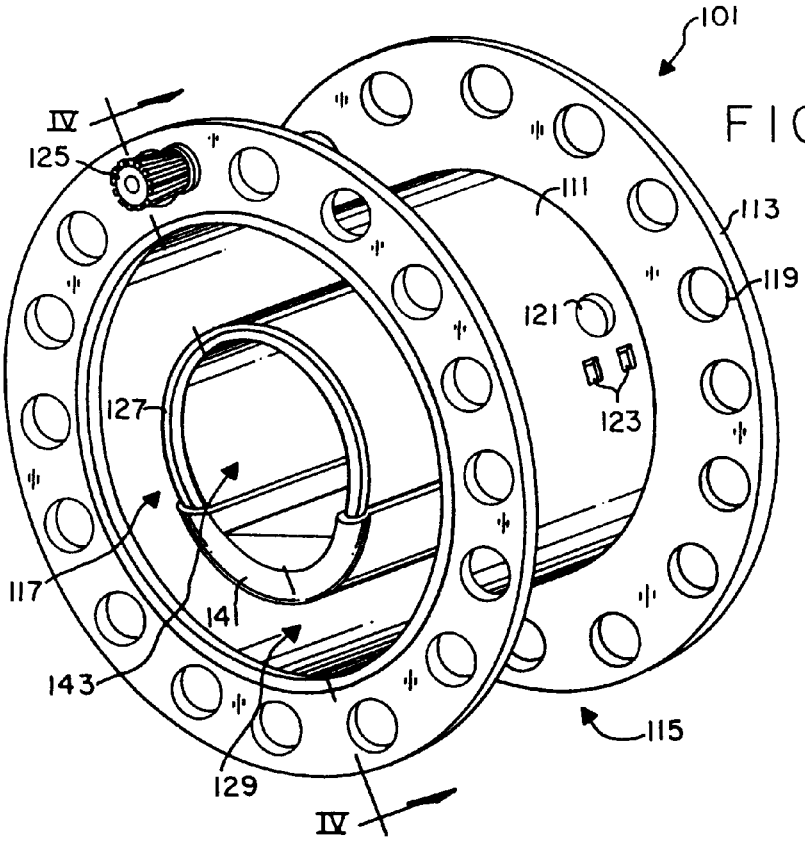
FIG. 2 is a perspective view of one alternative embodiment of a hose reel of the present invention.
Figure 3:
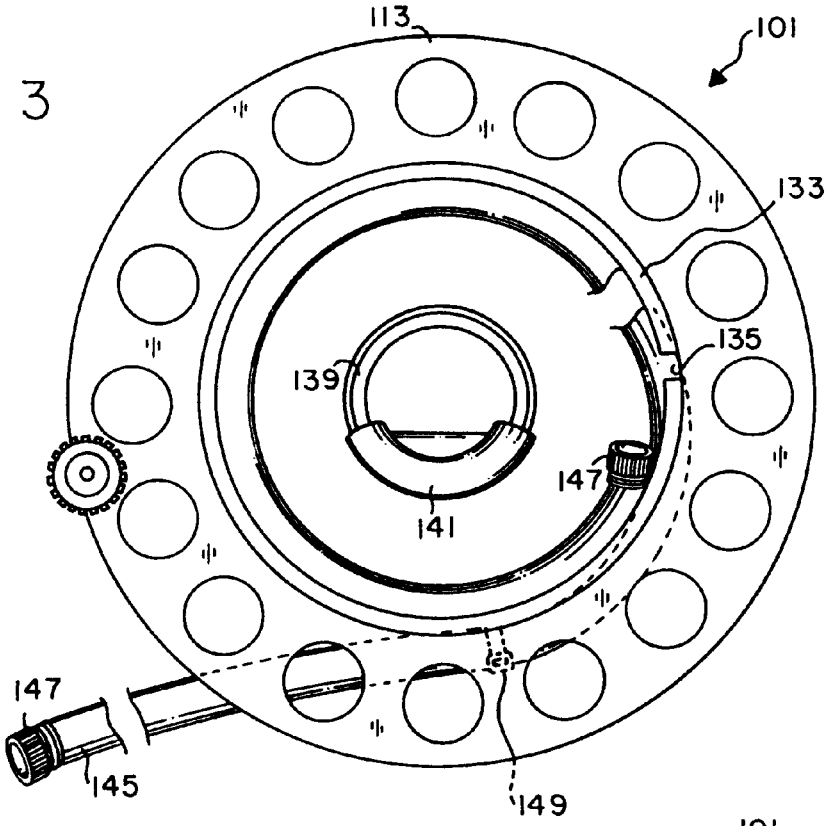
FIG. 3 is a side elevational view of the hose reel shown in FIG. 2.
Figure 4:
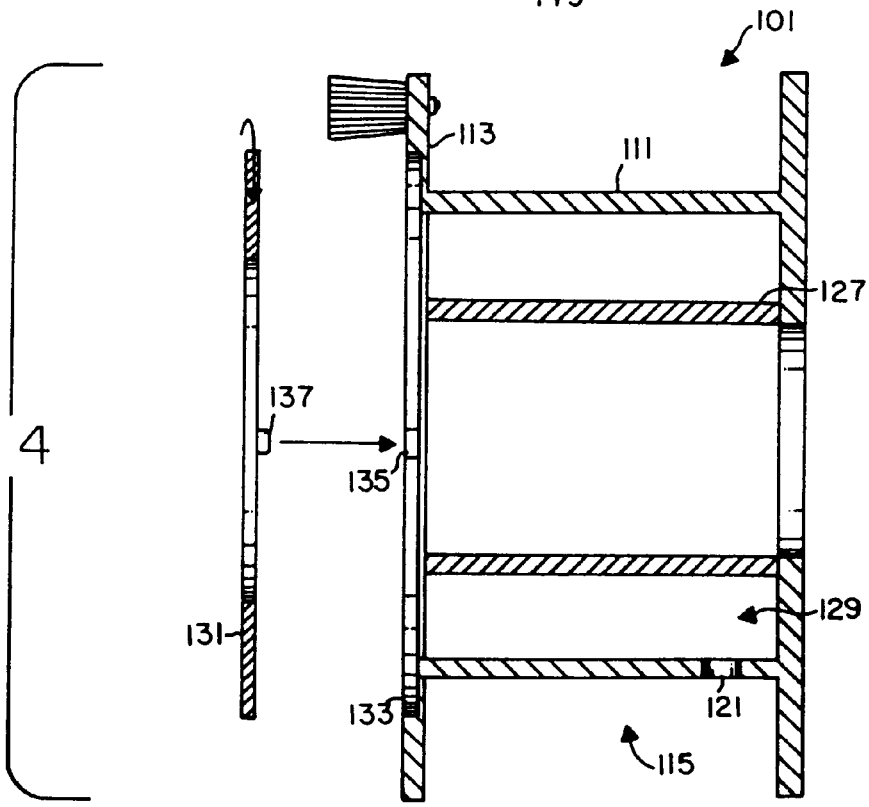
FIG. 4 is a cross-sectional, exploded elevational view of the hose reel taken along line IV—IV in FIG. 2.

FIGS. 2–4 display a first alternative embodiment of a hose reel 101 of the present invention. The first alternative embodiment is a hand-held hose reel 101. Hose reel 101 requires only one hose 145. In addition, hose reel 101 does not require a pipe similar to pipe 19 extending through hub 11 of conventional hose reel 1.

Hose reel 101 includes an outer hub 111 flanked by walls 113 at each end. Walls 113 can include apertures 119 therethrough to reduce the weight of hose reel 101 and to allow an operator to visualize the amount of hose 145 present in a first storage area 115.

Outer hub 111 and walls 113 form first storage area 115. Hose reel 101 winds and unwinds the portion of hose 145 located within first storage area 115 using a handle 125. The portion of hose 145 located within first storage area 115 includes a conventional hose coupling 147.

Outer hub 111 has a hollow interior 117 extending between its opposite ends. Outer hub 111 includes an opening, or aperture 121, which allows hose 145 to pass therethrough. Accordingly, the remainder of hose 145 not located in first storage area 115 resides within hollow interior 117. The portion of hose 145 located within hollow interior 117 includes a conventional hose coupling 147. A pair of smaller apertures 123 allow a fastener 149, such as a cable tie, to secure hose 145 to outer hub 111.

An inner hub 127 resides within hollow interior 117 of outer hub 111. Inner hub 127 could, for example, be secured to wall 113 at one end of outer hub 111. The area between inner hub 127 and outer hub 111 form a second storage area 129. Second storage area 129 partially coextends with hollow interior 117.

In order to retain the portion of hose 145 within second storage area 129 during winding or unwinding of the remainder of hose 145 in first storage area 115, a plate 131 secures to wall 113. Wall 113 has an annular groove 133 with a notched portion 135. Plate 131 includes a projection 137. Plate 131 seats within groove 133 when projection 137 aligns with notched portion 135. Rotation of plate 131 locks plate 131 within groove 133 since projection 137 cannot exit through notched portion 135.

When the operator requires access to the portion of hose 145 within second storage area 129, plate 131 is rotated to align projection 137 with notched portion 135. Access to the portion of hose 145 within second storage area 129 can be required when, for example, hose 145 has been unwound from hose reel 101 and is ready for use.

Hose reel 101 has a hand-held configuration. To wind and unwind hose reel 101 by hand, inner hub 127 has grooves 139 at each end. A sleeve, or grip 141, extends through a hollow interior 143 of inner hub 127. Projections (not shown) on grip 141 seat within grooves 139. To unwind hose reel 101, the operator supports hose reel 101 by grip 141 and plays hose 145 from first storage area 115. To wind, the operator supports hose reel 101 by grip 141 and rotates hub 111 by manipulating handle 125. Rotation of hub 111 winds hose 145 in first storage area 115.

During winding and unwinding of hose reel 101, the portion of the hose residing within second storage area 129 remains within second storage area 129 by using plate 131. This ensures that the portion of the hose within second storage area 129 does not tangle with the other portion of the hose during winding and unwinding operations.

The operator uses hose reel 101 as follows. The operator plays a length of hose 145 from first storage area 115 by holding grip 141 and pulling hose 145. The length of hose 145 removed depends on the requirements of the application performed. The operator secures coupling 147 of hose 145 to a corresponding coupling (not shown) on a device (not shown) used to perform the application. For instance, in the food service industry, the device to which hose 145 attaches could be a process vessel (not shown).

The operator then opens second storage area 129 by removing plate 131. The operator removes a length of hose 145 from second storage area 129. The operator secures coupling 147 at the opposite end of hose 145 to a corresponding coupling (not shown) on, for example, a fluid supply line (not shown).

The fluid only passes through hose 145 to perform the application. As discussed above, hose reel 101 does not use any interior piping, nor is an additional supply line required.

When the operator completes the desired application, the operator replaces the portion of hose 145 that was removed from second storage area 129. The operator secures hose 145 within second storage area 129 by securing cover 131 thereon. The operator can now wind the remainder of hose 145 onto first storage area 115 using grip 141 and handle 125.

Figure 5:
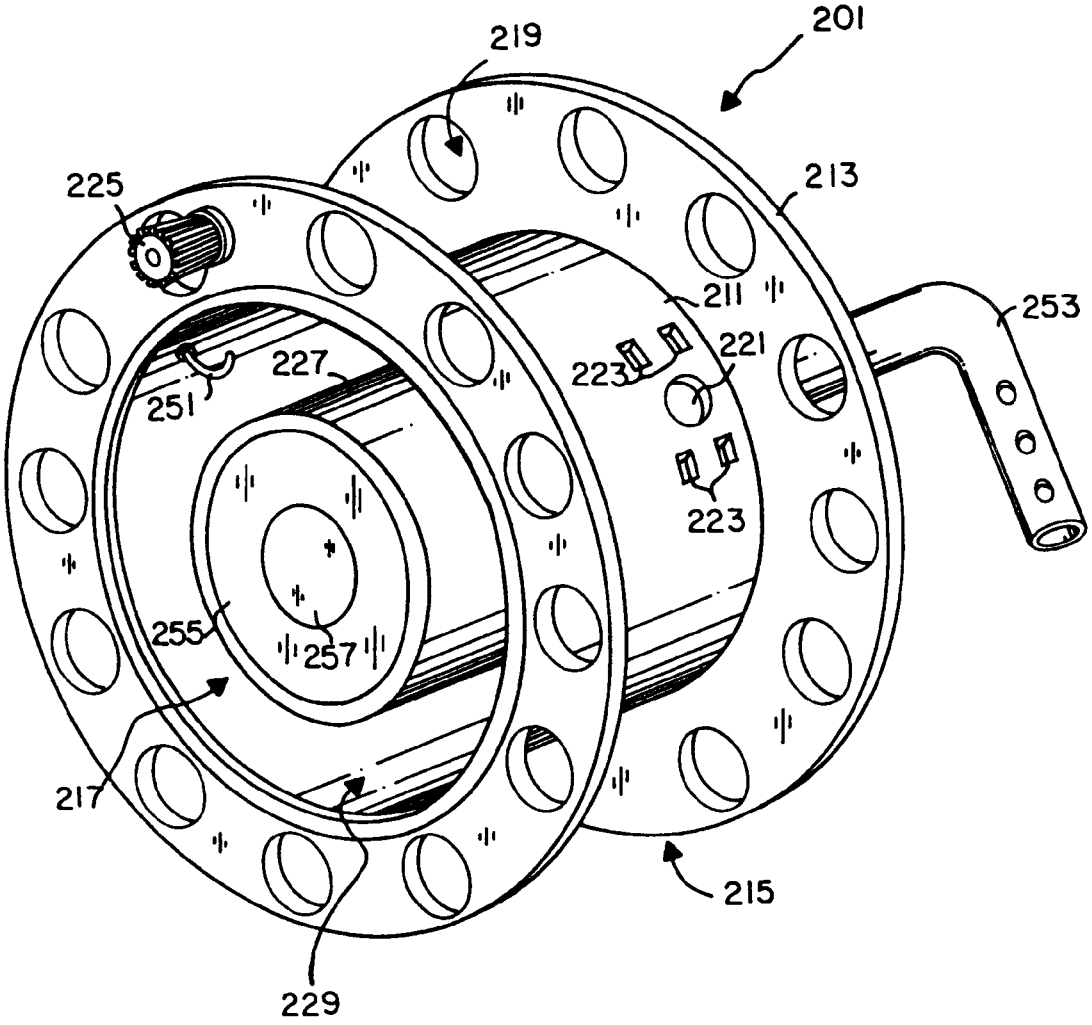
FIG. 5 is a perspective view of another alternative embodiment of a hose reel of the present invention.

FIG. 5 displays a second alternative embodiment of a hose reel 201 of the present invention. The second embodiment is a mounted hose reel 201. Features on hose reel 201 similar to the features on hose reel 101 use the same reference numeral, except for a change in the hundred digit.

Hose reel 201 includes an outer hub 211 flanked by walls 213 at each end. Walls 213 can include apertures 219 therethrough to reduce the weight of hose reel 201 and to allow an operator to visualize the amount of hose present in a first storage area 215.

Outer hub 211 and walls 213 form first storage area 215. Hose reel 201 winds and unwinds the portion of the hose located within first storage area 215 using a handle 225. The portion of the hose located within first storage area 215 includes a conventional hose coupling.

Outer hub 211 has a hollow interior 217 extending between its opposite ends. Outer hub 211 includes an aperture 221 which allows the hose to pass therethrough. Accordingly, the remainder of the hose not located in first storage area 215 resides within hollow interior 217. The portion of the hose located within hollow interior 217 also includes a conventional hose coupling. Two pairs of smaller apertures 223 flanking aperture 221 allow a fastener, such as a cable tie, to secure the hose to outer hub 211.

An inner hub 227 resides within hollow interior 217 of outer hub 211. Inner hub 227 could, for example, be secured to wall 213 at one end of outer hub 211. The area between inner hub 227 and outer hub 211 form a second storage area 229. Second storage area 229 partially coextends with hollow interior 217.

In order to retain the portion of the hose within second storage area 229 during winding or unwinding of the remainder of the hose in first storage area 215, outer hub 211 includes a fastener, such as a hook 251. A portion of the hose secures to hook 251. Thus, as hose reel 201 rotates, hook 251 retains the portion of the hose in second storage area 229.

When the operator requires access to the hose within second storage area 229, the operator merely disengages the hose from hook 251. The operator can then unwind the portion of the hose in second storage area 229.

Hose reel 201 can mount to any object, such as a wall (not shown), bench (not shown), tank (not shown), hand cart (not shown) or other mobile equipment (not shown). Hose reel 201 mounts to the object using, for example, a mounting arm 253. Mounting arm 253 secures to the object in a conventional manner. A bearing assembly 255 allows rotation of inner hub 227 relative to an axle, or shaft 257, extending through inner hub 227. Shaft 257 can be a portion of mounting arm 253.

To operate hose reel 201, the operator plays a length of the hose from first storage area 215. The length of hose removed depends on the requirements of the application performed. The operator secures a coupling of the hose to a corresponding coupling (not shown) on a device (not shown) used to perform the application. For instance, in the food service industry, the device to which the hose attaches could be a process vessel (not shown).

The operator then removes the hose from hook 251 and removes a length of the hose from second storage area 229. The operator secures a coupling at the opposite end of the hose to a corresponding coupling (not shown) on, for example, a fluid supply line (not shown).

When the operator completes the desired application, the operator replaces the portion of the hose that was removed from second storage area 229. The operator secures the hose within second storage area 229 by securing the hose to hook 251. The operator can now wind the remainder of the hose onto first storage area 215 by rotating handle 225.

The present invention can be made from any suitable material, such as plastic or metal. Applicants also understand that many other variations are apparent to one of ordinary skill in the art from a reading of the above specification. Such variations are within the spirit and scope of the instant invention as defined by the following appended claims.

I claim:

1. A hose reel comprising:

a unitary hose having a first end, a second end and a medial portion extending between said first end and said second end;

an outer hub including:

opposite ends;

a hollow interior extending between said opposite ends; and an opening through said hub and in communication win said hollow interior;

a pair of walls, each attached to a respective one of said opposite ends of said outer hub, said pair of walls and said outer hub defining a first storage area therebetween;

an inner hub attached lo said outer hub and positioned within said hollow interior of said outer hub, said inner hub and said outer hub defining a second storage area therebetween;

said first end and a first length of said medial portion of said hose reside within said first storage area;

said medial portion passing through said opening in said outer hub; and said second end and a remainder of said medial portion of said hose reside within said second storage area;

whereby said hose is a single hose without interruption and said hose reel stores said hose when not in use and dispenses said hose when desired.

2. The reel as recited in claim 1, further comprising a means for rotating the reel.

3. The reel as recited in claim 2, wherein said means for rotating the reel comprises:

a shaft positioned within said inner hub; and a bearing located between said shaft and said inner hub to allow rotation of said inner hub relative to said shaft.

4. The reel as recited in claim 2, wherein said means for rotating comprises a sleeve extending through said inner hub and having flanges at opposite ends adjacent opposite ends of said inner hub.

5. The reel as recited in claim 1, further comprising a means for retaining the hose within said second storage area.

6. The reel as recited in claim 5, wherein said retaining means comprises a removable cover secured to one of said pair of walls.

7. The reel as recited in claim 5, wherein said retaining means comprises a fastener located within said second storage area.

8. The reel as recited in claim 7, wherein said fastener extends from said outer hub into said second storage area.

9. The reel as recited in claim 1, further comprising at least one pair of apertures extending through said outer hub and positioned adjacent said opening.

10. The reel as recited in claim 9, wherein said at least one pair of apertures comprises a plurality of pairs of apertures.

11. A fluid handling system, comprising:

a single hose having:

opposite ends comprised of a first end and a second end; and a medial portion extending between said first end and said second end;

a hose reel including:

an outer hub having:

opposite ends;

a hollow interior extending between said opposite ends; and an opening through said hub and in communication with said hollow interior;

a pair of walls, each attached to a respective one of said opposite ends of said outer hub, said pair of walls and said outer hub defining a first storage area therebetween; and an inner hub attached to said outer hub and positioned within said hollow interior of said outer hub, said inner hub and said outer hub defining a second storage area therebetween;

said first end and a first length of said medical portion of said hose located within said first storage area;

said medial portion passing through said opening; and said second end and a remainder of said medial portion of said hose located within said second storage area;

wherein said hose is a single hose and said hose reel stores said hose when not in use and dispenses said hose when necessary.

12. The fluid handling system as recited in claim 11, further comprising a means for rotating the reel.

13. The fluid handling system as recited in claim 11, further comprising a means for retaining the hose within said second storage area.

14. The fluid handling system as recited in claim 11, further comprising at least one pair of apertures extending through said outer hub and positioned adjacent said opening.

15. The fluid handling system as recited in claim 12, wherein said means for rotating the reel comprises:

a shaft positioned within said inner hub; and a bearing located between said shaft and said inner hub to allow rotation of said inner hub relative to said shaft.

16. The fluid handling system as recited in claim 12, wherein said means for rotating comprises a sleeve extending through said inner hub and having flanges at opposite ends adjacent opposite ends of said inner hub.

17. The fluid handling system as recited in claim 13, wherein said retaining means comprises a removable cover secured to one of said pair of walls.

18. The fluid handling system as recited in claim 13, wherein said retaining means comprises a fastener located within said second storage area.

19. A reel for receiving a hose having ends and a medial portion extending between said hose ends, said reel comprising:

an outer hub including:

opposite ends;

a hollow interior extending between said opposite ends; and an opening through said hub and in communication with said hollow interior;

a first wall attached to one of said opposite ends of said outer hub;

a second wall attached the other one of said opposite ends of said outer hub, said second wall having:

an annular groove; and a notch in said annular groove;

wherein said first wall, said second wall and said outer hub defining a first storage area therebetween;

an inner hub attached to said first wall and positioned within said hollow interior of said outer hub, said inner hub and said outer hub defining an annular-shaped second storage area therebetween; and a removable plate seatable within said annular groove of said second wall, said plate having:

an outer edge corresponding to said annular groove of said second wall; and a projection corresponding to said notch in said second wall for seating said plate within said annular groove, said plate being rotatable so that said plate remains within said annular groove of said second wall when said projection is no longer aligned with said notch in said second wall;

whereby said aperture can receive the medial portion of the hose so that a first length of the hose resides within said first storage area and a second length of the hose resides within said second storage area.

20. The reel as recited in claim 19, further comprising at least one pair of apertures extending through said outer hub and positioned adjacent said opening.

* * * * *